US006769204B1

(12) United States Patent
Phillips

(10) Patent No.: US 6,769,204 B1
(45) Date of Patent: Aug. 3, 2004

(54) SANDAL SYSTEM

(76) Inventor: Lindsay M. Phillips, 34 N. Pine Cir., Belleair, FL (US) 33756

( * ) Notice: Subject to any disclaimer, the term of this patent is extended or adjusted under 35 U.S.C. 154(b) by 29 days.

(21) Appl. No.: 10/235,449

(22) Filed: Sep. 5, 2002

(51) Int. Cl.[7] ..... A43B 3/24; A43B 23/00
(52) U.S. Cl. ..... 36/136; 36/100; 36/11.5
(58) Field of Search ..... 36/11.5, 100, 101, 36/136

(56) References Cited

U.S. PATENT DOCUMENTS 3,011,281 A * 12/1961 King ..... 36/11.5
3,032,896 A * 5/1962 Weaver ..... 36/101
3,119,191 A * 1/1964 Vitzthum ..... 36/84
3,930,322 A * 1/1976 Endo et al. ..... 36/11.5
4,525,940 A * 7/1985 Mochizuki ..... 36/8.1
5,800,900 A * 9/1998 Mitchell ..... 428/100

* cited by examiner

*Primary Examiner*—M. D. Patterson
(74) *Attorney, Agent, or Firm*—Larson & Larson, PA; James E. Larson

(57) ABSTRACT

A sandal system comprises a sole. The sole has top and bottom surfaces. The bottom surface has a periphery and a heel portion. A foot retaining strap is provided. The strap has ends coupled to the sole. A central extent is provided between the ends. Top and bottom faces are provided. A first hook and loop fastener is provided. The hook and loop fastener has an upper side and a lower side coupled with the top face of the strap. Finally, a decorative ribbon is provided. The ribbon has an upper plane adapted to have decorations and a lower plane having a second hook and loop fastener being adapted to releasably couple with the upper side of the first hook and loop fastener. The first and second hook and loop fasteners are essentially coextensive in size.

1 Claim, 3 Drawing Sheets

FIG 3
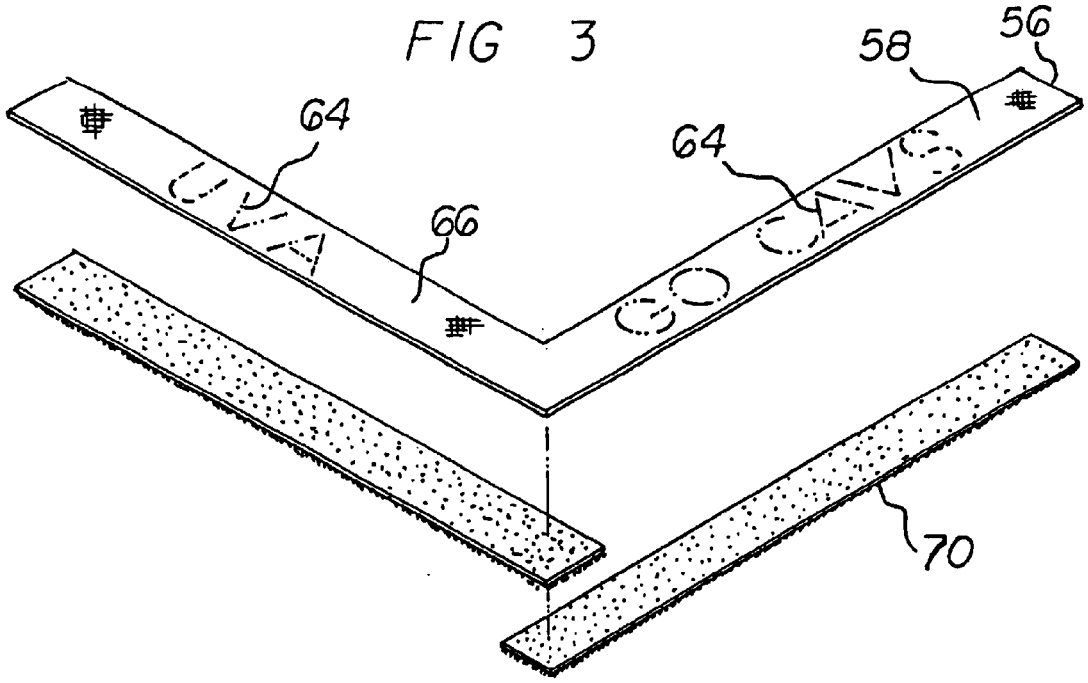
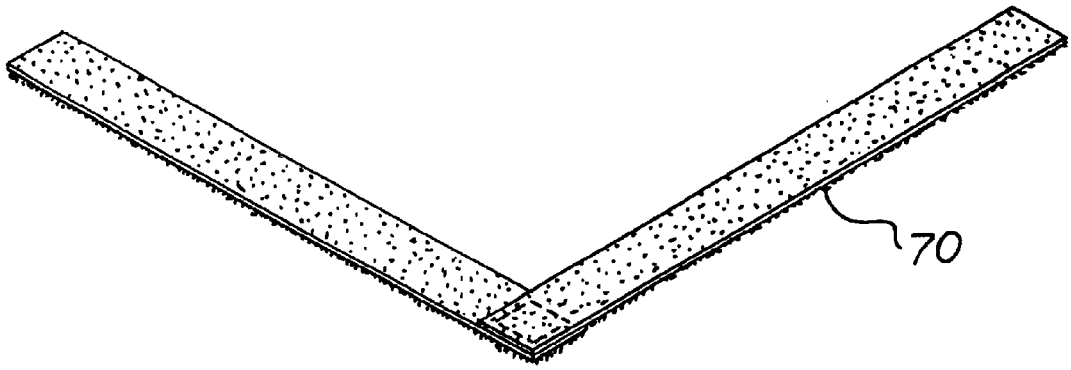
FIG 4

SANDAL SYSTEM

BACKGROUND OF THE INVENTION

1. Field of the Invention

The present invention relates to a sandal system and more particularly pertains to providing a plurality of interchangeable surfaces for sandals.

2. Description of the Prior Art

The use of footwear of known designs and configurations is known in the prior art. More specifically, footwear of known designs and configurations previously devised and utilized for the purpose of selectively changing the appearance of apparel through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,011,281 to King discloses a shoe decorative device. U.S. Pat. No. 4,114,296 to Smith discloses an interchangeable sandal. U.S. Pat. No. 5,496,612 to Ransbottom discloses an ornamental attachment for a shoe. U.S. Pat. No. 5,778,564 to Kettner discloses an interchangeable shoe cover. U.S. Pat. No. 1,555,418 to Kennedy discloses an adjustable decoration for shoes. Finally, U.S. Pat. No. Des. 343,947 to Coito et al. discloses a pedicure slipper.

While these devices fulfill their respective, particular objectives and requirements, the aforementioned patents do not describe a sandal system that allows providing a plurality of interchangeable surfaces for sandals.

In this respect, the sandal system according to the present invention substantially departs from the conventional concepts and designs of the prior art, and in doing so provides an apparatus primarily developed for the purpose of providing a plurality of interchangeable surfaces for sandals.

Therefore, it can be appreciated that there exists a continuing need for a new and improved sandal system which can be used for providing a plurality of interchangeable surfaces for sandals. In this regard, the present invention substantially fulfills this need.

SUMMARY OF THE INVENTION

In view of the foregoing disadvantages inherent in the known types of footwear of known designs and configurations now present in the prior art, the present invention provides an improved sandal system. As such, the general purpose of the present invention, which will be described subsequently in greater detail, is to provide a new and improved sandal system and method which has all the advantages of the prior art and none of the disadvantages.

To attain this, the present invention essentially comprises a sole. The sole is provided in a generally oblong configuration. The sole is fabricated of an elastomeric material. The elastomeric material is of a limited extensibility. A periphery is provided around the sole. The sole has a smooth top surface. The sole has a rough bottom surface for traction. The sole has a toe portion of a first diameter. The sole further has a heel portion of a second diameter. The second diameter is less than the first diameter. The sole has a first aperture. The first aperture extends through the sole adjacent to the toe portion. The sole has a pair of second apertures. The second apertures extend through the sole on opposite sides between the heel portion and the first aperture adjacent to the periphery. The apertures each have an adjacent recessed portion in the bottom surface. A foot retaining strap is provided. The strap is of an elastomeric material. The elastomeric material is of a limited extensibility. The strap is formed of two rectangular segments. The strap has a generally cylindrical toe end, a central bifurcation and a pair of planar heel ends. The strap has a top face and a bottom face. The toe end is adapted to pass through the first aperture of the toe portion. The heel ends are adapted to pass through the respective second apertures in the sole. The end portions are coupled to the sole with bulbs. The bulbs are adapted to reside within the recess portion adjacent to the apertures. Further provided is a first hook and loop fastener. The first hook and loop fastener has an upper side and a lower side. The lower side is adapted to receive adhesive to couple with the top face of the strap. Provided last is a decorative ribbon. The ribbon has an upper plane. The upper plane is adapted to have decorations, such as buttons and fabric stars, on one ribbon and indicia on another ribbon. A lower plane is provided. The lower plane has a second hook and loop fastener. The second hook and loop fastener is adapted to releasably couple with the first side of the first hook and loop fastener.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sandal system which has all of the advantages of the prior art footwear of known designs and configurations and none of the disadvantages.

It is another object of the present invention to provide a new and improved sandal system which may be easily and efficiently manufactured and marketed.

It is further an object of the present invention to provide a new and improved sandal system which is of durable and reliable constructions.

An even further object of the present invention is to provide a new and improved sandal system which is susceptible of a low cost of manufacture with regard to both materials and labor, and which accordingly is then susceptible of low prices of sale to the consuming public, thereby making such sandal system economically available to the buying public.

Even still another object of the present invention is to provide a sandal system for providing a plurality of interchangeable surfaces for sandals.

Lastly, it is an object of the present invention to provide a new and improved sandal system comprising a sole. The sole has top and bottom surfaces. The bottom surface has a periphery and a heel portion. A foot retaining strap is provided. The strap has ends coupled to the sole. A central extent is provided between the ends. Top and bottom faces are provided. A first hook and loop fastener is provided. The hook and loop fastener has an upper side and a lower side coupled with the top face of the strap. Finally, a decorative ribbon is provided. The ribbon has an upper plane adapted to have decorations and a lower plane having a second hook and loop fastener being adapted to releasably couple with the upper side of the first hook and loop fastener. The first and second hook and loop fasteners are essentially coextensive in size.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an exploded perspective view of the decorative ribbon and associated Velcro straps illustrated in FIGS. 1 and 2 but shown in a different optional decoration.

FIG. 4 is a perspective view of the Velcro components prior to attachment to the decorative ribbon.

The same reference numerals refer to the same parts throughout the various Figures.

DESCRIPTION OF THE PREFERRED EMBODIMENT

Figure 1:
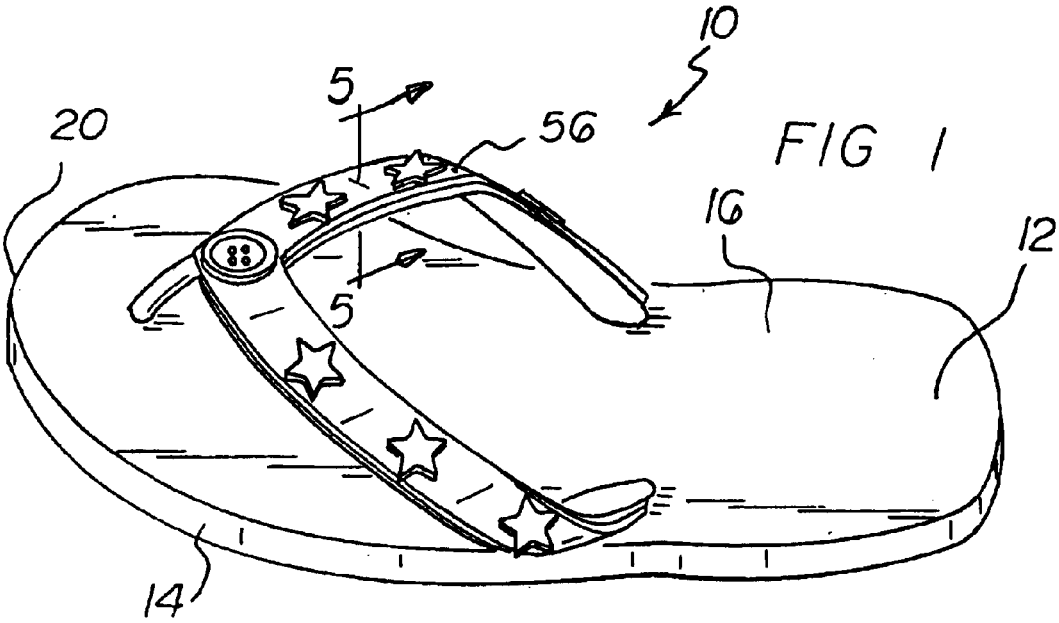
FIG. 1 is a perspective view of a sandal system constructed in accordance with the principles of the present invention.
Figure 2:
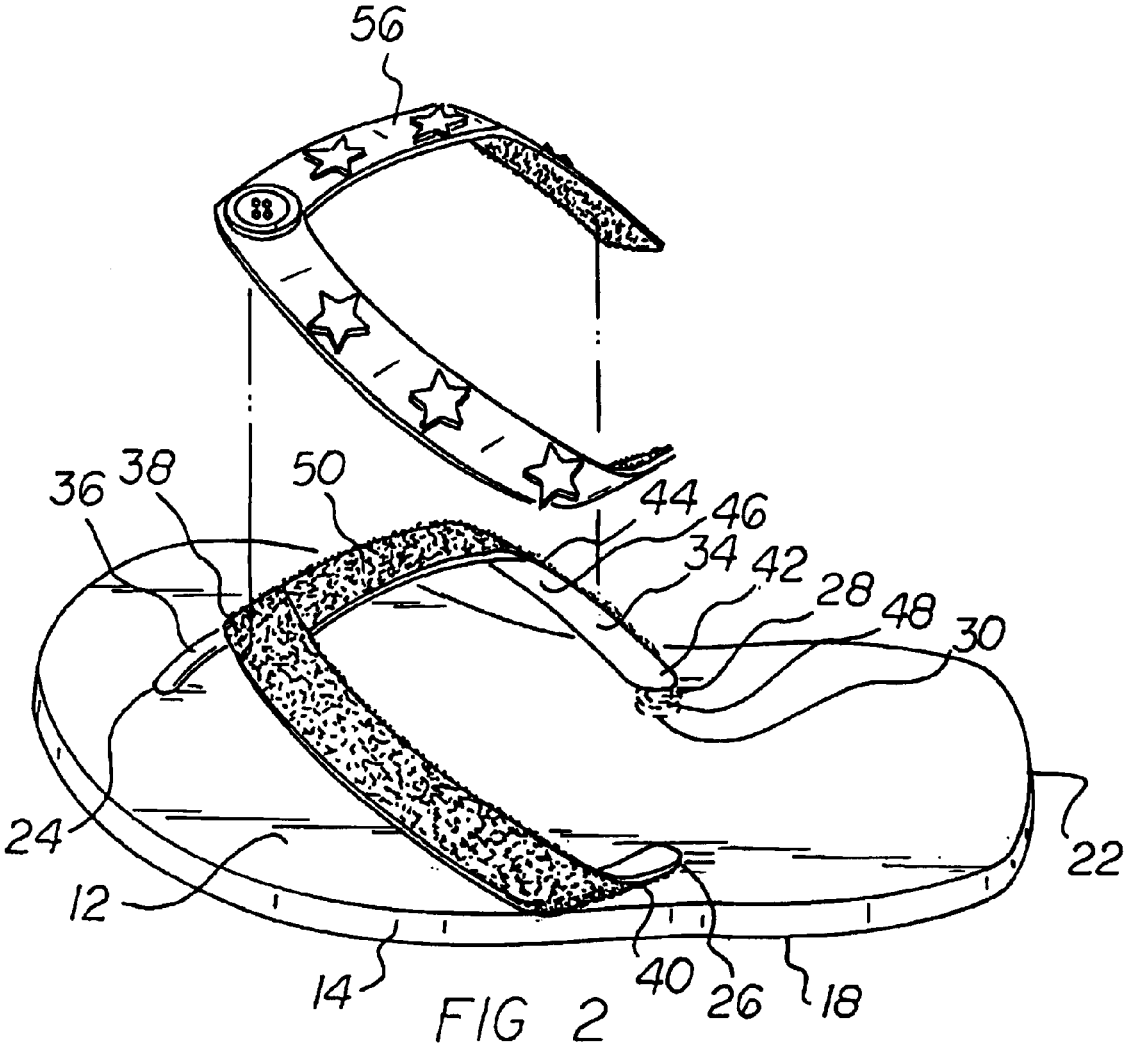
FIG. 2 is an exploded perspective view of the sandal system similar to FIG. 1.
Figure 5:
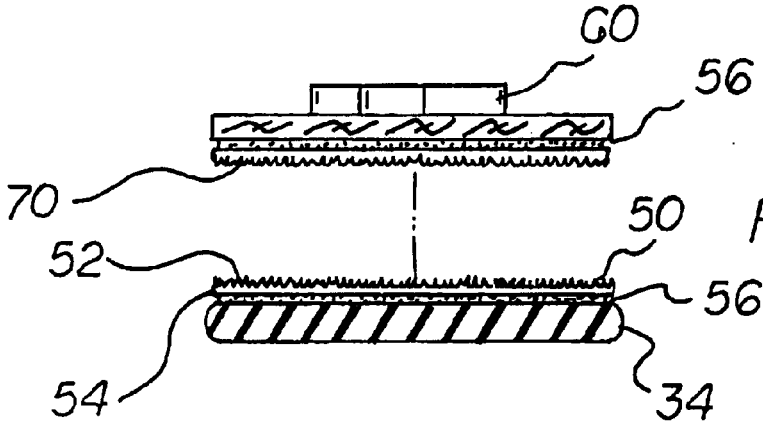
FIG. 5 is an exploded cross sectional view through the ribbon and the Velcro taken along line 5—5 of FIG. 1.

With reference now to the drawings, and in particular to FIG. 1 thereof, the preferred embodiment of the new and improved sandal system embodying the principles and concepts of the present invention and generally designated by the reference numeral 10 will be described.

The present invention, the sandal system 10 is comprised of a plurality of components. Such components in their broadest context include a sole, a foot retaining strap, a first hook and loop fastener and a decorative ribbon. Such components are individually configured and correlated with respect to each other so as to attain the desired objective.

First provided is a sole 12. The sole is provided in a generally oblong configuration. The sole is fabricated of an elastomeric material. The elastomeric material is of a limited extensibility. A periphery 14 is provided around the sole. The sole has a smooth top surface 16. The sole has a rough bottom surface 18 for traction. The sole has a toe portion 20 of a first diameter. The sole further has a heel portion 22 of a second diameter. The second diameter is less than the first diameter. The sole has a first aperture 24. The first aperture extends through the sole adjacent to the toe portion. The sole has a pair of second apertures 26, 28. The second apertures extend through the sole on opposite sides between the heel portion and the first aperture adjacent to the periphery. The apertures each have an adjacent recessed portion 30 in the bottom surface.

A foot retaining strap 34 is provided. The strap is in a generally Y-shaped configuration and is fabricated of an elastomeric material. The elastomeric material is of a limited extensibility. The strap has a generally cylindrical toe end 36, a central bifurcation 38 and a pair of planar heel ends 40, 42. The strap has a top face 44 and a bottom face 46. The toe end is adapted to pass through the first aperture of the toe portion. The heel ends are adapted to pass through the respective second apertures in the sole. The end portions are coupled to the sole with bulbs 48. The bulbs are adapted to reside within the recess portion adjacent to the apertures.

Further provided is a first hook and loop fastener 50. The first hook and loop fastener has an upper side 52 and a lower side 54. The lower side is adapted to receive adhesive 56 to couple with the top face of the strap.

Provided last is a decorative ribbon 56 fabricated of a generally inextensible material, preferably a woven plastic, such as nylon. The ribbon has an upper plane 58. The upper plane is adapted to have decorations 60, such as buttons and fabric stars, on one ribbon and indicia 64 on another interchangeable ribbon 66. A lower plane is provided. The lower plane has a second hook and loop fastener 70. The straps 70 are rectangular and overlap where coupled. Compare FIGS. 3 and 4. The second hook and loop fastener is adapted to releasably couple with the upper side of the first hook and loop fastener.

Figure 6:
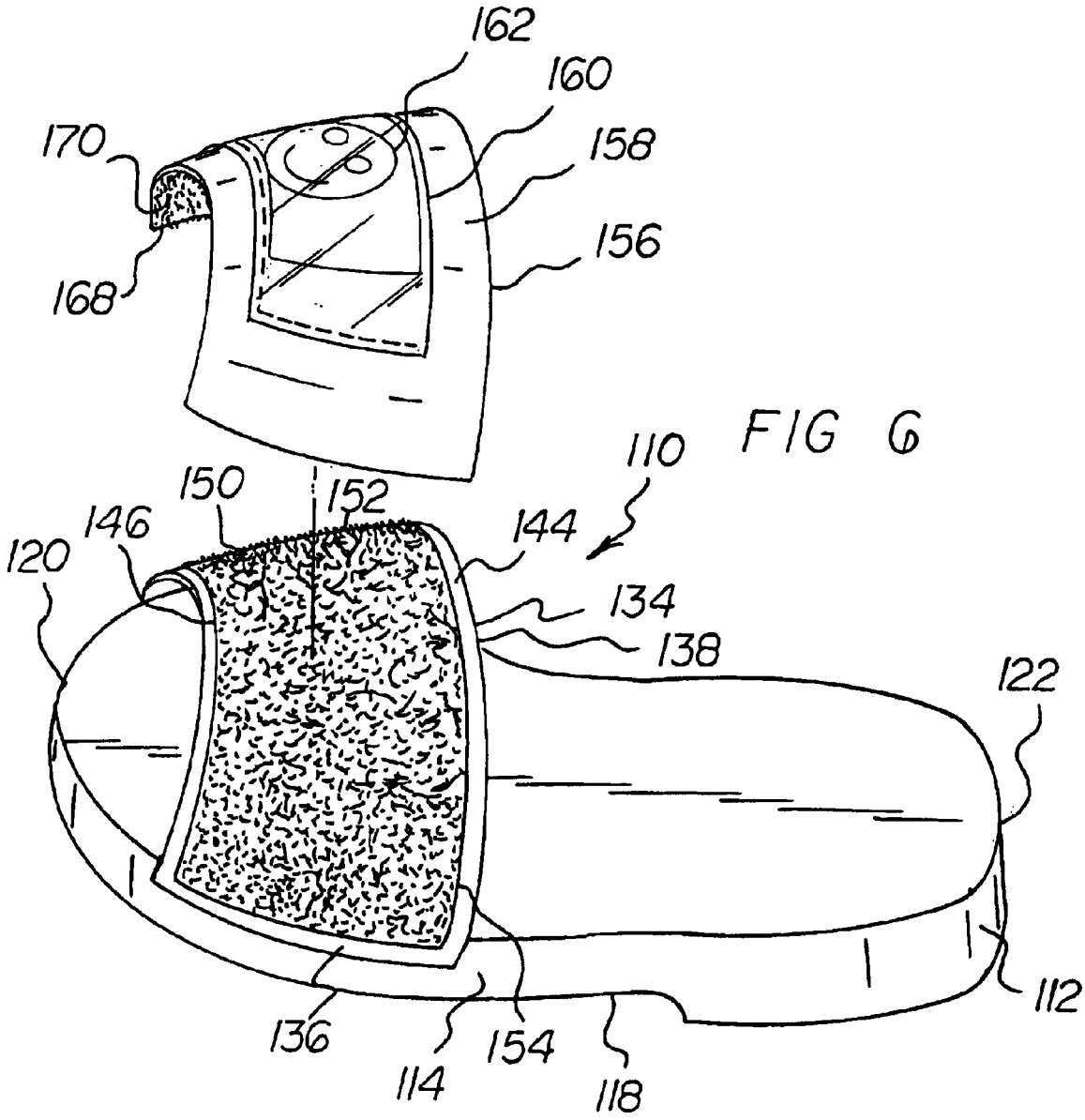
FIG. 6 is an exploded perspective view similar to FIG. 2 but illustrating an alternate embodiment of the invention.

In an alternate embodiment of the present invention, shown in FIG. 6, the system 110 includes a sole 112. The sole is in a generally oblong configuration. The sole is fabricated of an essentially inextensible material. The inextensible material is preferably wood. A periphery 114 is provided around the sole. The sole has a smooth top surface. The sole has a rough bottom surface 118 for traction. The sole further has a toe portion 120 of a first diameter. The sole has a heel portion 122 of a second diameter. The second diameter is less than the first diameter. The sole has a first aperture adjacent to the toe portion.

A foot retaining strap 134 is provided. The strap is fabricated of an essentially inextensive material. The inextensible material is preferably a woven nylon. The strap has opposed ends 136. The opposed ends are secured to the periphery of the sole, preferably by adhesive or tacks or the like. A central extent 138 is provided between the opposed ends. The strap has a top face 144 and a bottom face 146.

Provided next is a first hook and loop fastener 150. The first hook and loop fastener has an upper side 152 and a lower side 154. The lower side is adapted to receive adhesive to couple with the top face of the strap.

Further provided is a decorative ribbon 156. The decorative ribbon has an upper plane 158. The upper plane has a transparent window 160 adapted to removably receive decorations or pictures 162. A lower plane 168 is provided. The lower plane has a second hook and loop fastener 170. The second hook and loop fastener is adapted to releasably couple with the upper side of the first hook and loop fastener.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A sandal system for providing a plurality of interchangeable decorative surfaces comprising, in combination:

a sole in a generally oblong configuration and fabricated of an elastomeric material of a limited extensibility and having a periphery there around, a smooth top surface and a rough bottom surface for traction, a toe portion of a first diameter and a heel portion of a second diameter less than the first diameter, the sole having a first aperture extending there through from the top to the bottom surface of the sole adjacent to the toe portion and a pair of second apertures extending there through from the top to the bottom surface of the sole on opposite sides between the heel portion and the first aperture adjacent to the periphery, the apertures each having an adjacent recessed portion in the bottom surface;

a foot retaining strap of an elastomeric material of a limited extensibility, the strap having a top face adhesively attached to a first pair of rectangular hook and loop fasteners, the fasteners overlapping at a first portion, the strap having a generally cylindrical toe end descending from the front portion of the overlapping fasteners, the strap further having a central bifurcation and a pair of planar heel ends, the strap ends having a top face and a bottom face, the toe end being adapted to pass through the first aperture of the toe portion and the heel ends being adapted to pass through the respective second apertures in the heel portion, the end portions being coupled to the sole with bulbs adapted to reside within the recess portion adjacent to the apertures;

the first pair of hook and loop fasteners having an upper side and a lower side adapted to receive adhesive to couple with the top face of the strap; and a decorative ribbon having an upper plane adapted to have decorations on one ribbon and indicia on another ribbon and a lower plane having a second pair of hook and loop fasteners, essentially coextensive in size and shape with, and adapted to releasably couple with, the upper side of the first hook and loop fasteners.

* * * * *